US010871277B2

(12) United States Patent
Kallus et al.

(10) Patent No.: US 10,871,277 B2
(45) Date of Patent: Dec. 22, 2020

(54) LAMP WITH PLURALITY OF MOUNTING ORIENTATIONS

(71) Applicant: blomus GmbH, Sundern (DE)

(72) Inventors: Florian Kallus, Cologne (DE); Sebastian Schneider, Cologne (DE)

(73) Assignee: Blomus GmbH, Sundern (DE)

( * ) Notice: Subject to any disclaimer, the term of this patent is extended or adjusted under 35 U.S.C. 154(b) by 0 days.

(21) Appl. No.: 16/655,901

(22) Filed: Oct. 17, 2019

(65) Prior Publication Data

US 2020/0292155 A1 Sep. 17, 2020

(30) Foreign Application Priority Data

Mar. 14, 2019 (DE) ..... 20 2019 101 459 U

(51) Int. Cl.

| | |
|---|---|
| ***F21S 8/08*** | (2006.01) |
| ***F21V 19/02*** | (2006.01) |
| ***F21S 6/00*** | (2006.01) |
| ***F21S 8/06*** | (2006.01) |
| ***F21V 23/04*** | (2006.01) |
| ***F21V 21/116*** | (2006.01) |
| ***F21S 9/02*** | (2006.01) |
| ***F21V 21/112*** | (2006.01) |

(52) U.S. Cl.

CPC ..... *F21V 19/02* (2013.01); *F21S 6/00* (2013.01); *F21S 8/061* (2013.01); *F21S 9/02* (2013.01); *F21V 21/112* (2013.01); *F21V 21/116* (2013.01); *F21V 23/0485* (2013.01)

(58) Field of Classification Search

CPC ... F21S 8/032; F21S 8/08; F21S 8/088; F21V 21/008; F21V 1/14; F21V 11/116; F21V 1/116

See application file for complete search history.

(56) References Cited

U.S. PATENT DOCUMENTS 1,614,102 A * 1/1927 Cary ..... F21S 6/002 362/412
3,225,187 A * 12/1965 Curtin ..... F21S 8/088 250/215
3,950,639 A * 4/1976 Van Steenhoven ..... F21S 8/088 362/309
4,211,959 A * 7/1980 Deavenport ..... H02M 5/2576 315/362
4,507,716 A * 3/1985 Benedict, Jr. ..... F21V 23/04 362/295
4,549,252 A * 10/1985 Ripley ..... F21S 8/08 362/216
4,556,824 A * 12/1985 Cheng ..... H05B 39/085 315/209 R
5,010,460 A * 4/1991 Lin ..... F21S 6/002 362/101
5,208,516 A * 5/1993 Saidian ..... F21V 19/006 307/116

(Continued)

*Primary Examiner* — Ismael Negron

(74) *Attorney, Agent, or Firm* — Edell, Shapiro & Finnan, LLC

(57) ABSTRACT

A lamp, including an illuminant, a housing, and a shielding element, wherein the illuminant is situated in the housing, wherein the shielding element at least partially covers a first end area of the housing and protrudes from the first end area, characterized in that the shielding element has a first standing area that is directed away from the housing.

26 Claims, 4 Drawing Sheets

(56) References Cited

U.S. PATENT DOCUMENTS

| | | | | |
|---|---|---|---|---|
| 5,226,721 | A * | 7/1993 | Stokes | F21S 8/088<br>362/153.1 |
| 6,812,398 | B2 * | 11/2004 | Yueh | F21S 9/032<br>136/244 |
| 8,845,166 | B2 * | 9/2014 | Lederer | F21L 4/08<br>362/569 |
| 2008/0232094 | A1 * | 9/2008 | Ramsdell | F21S 8/088<br>362/153 |

* cited by examiner

LAMP WITH PLURALITY OF MOUNTING ORIENTATIONS

BACKGROUND

The present invention relates to a lamp according to the appended claims.

Lamps having an illuminant, a housing, and a shielding element are known from the prior art in which the illuminant is situated in the housing, and the shielding element partially covers an end area of the housing and protrudes from the end area.

SUMMARY

In contrast, the object of the present invention is to provide a lamp that can be used more flexibly.

This object is achieved by a lamp according to the appended claims. Embodiments of the invention are set forth in the appended claims.

The lamp comprises an illuminant, a housing, and a shielding element. The illuminant is situated in the housing. The shielding element at least partially covers a first end area and protrudes from the first end area. This is understood in particular to mean that an outer edge of the shielding element projects away from the housing.

The shielding element has a first standing area that is directed away from the housing. This first standing area may be used, for example, to set the lamp on a flat surface. Since the first standing area is directed away from the housing, the housing is situated above the shielding element when the first standing area is used to set the lamp on a flat surface.

The lamp is thus usable in a particularly flexible manner. In a first position it may be used as a conventional lamp, in which the shielding element is situated above the housing for the illuminant. In a second position the lamp is situated on the first standing area directed away from the housing, and may be set on a flat surface.

According to one embodiment of the invention, the first standing area may be designed to rest on a horizontal plane. This is understood in particular to mean that the entire first standing area may rest on the horizontal plane. In particular, the aim is for the lamp to be situated on the plane in a mechanically stable manner in this position. This is understood in particular to mean that the lamp cannot be tipped over by a force exerted vertically on the housing.

According to one embodiment of the invention, the first standing area may have a ring-shaped design. This is particularly advantageous in order for the first standing area not to detract from the appearance of the lamp when the shielding element is situated above the housing.

According to one embodiment of the invention, the housing may have a second standing area that is designed to rest on a horizontal plane. In this way, the lamp may also be stably set down directly via the housing.

According to one embodiment of the invention, the second standing area may be situated in a second end area of the housing situated opposite from the first end area. The lamp may thus be stably set on the housing in such a way that the shielding element is situated above the housing.

According to one embodiment of the invention, the lamp may have a recess that extends through the housing. The recess may, for example, extend through the entire housing or be designed as a blind hole.

According to one embodiment of the invention, the lamp may include a stand on which the housing may be placed. The flexibility of the lamp is thus further increased.

According to one embodiment of the invention, the stand may be introducible into the recess. Thus, for example, the lamp may be placed on the stand. It is possible for the stand to be introducible into the recess at the second end area or at the first end area. The flexibility of the lamp is thus further increased.

According to one embodiment of the invention, the recess may extend centrally through the housing. This is advantageous for a stable arrangement of the housing on the stand.

According to one embodiment of the invention, the stand may include a stop element. The stop element may have a shape that is complementary to the shape of the second end area of the housing. This is advantageous in particular for a stable arrangement of the housing on the stand. The complementary shape is understood in particular to mean that the second end area and the stop element may lie in flush alignment with one another when the stand is inserted into the recess.

According to one embodiment of the invention, the lamp may include a suspension means that is introducible into the recess. The suspension means may be designed, for example, to be hung on a cover. For this purpose, the suspension means may have a recess, for example, via which it may be hung on a fastening means by means of a cable. The flexibility of the lamp is thus further increased.

According to one embodiment of the invention, the suspension means may be introducible into the recess from a first side. The first side may be the side, for example, at which the first end area is situated. The stand may be introducible into the recess from a second side. The second side may be the side, for example, at which the second end area is situated. The first and second sides are situated opposite one another. In this embodiment, the recess may be used for the stand as well as for the suspension means.

According to one embodiment of the invention, the suspension means may be elastically deformable. In the elastically deformable state the suspension means may be insertable into the recess, and in the inserted state may be held in a form-fit manner. The suspension means may thus be fastened to the housing in a particularly simple manner.

According to one embodiment of the invention, the housing may have detent sections that face the recess. The detent sections may be designed as indentations, for example. The suspension means may have detent elements that engage with the detent sections in the inserted state of the suspension means into the recess. The suspension means may thus be securely held on the housing.

According to one embodiment of the invention, the shielding element may protrude circumferentially from the first end area of the housing. The shielding element may in particular protrude from the first end area of the housing around the entire circumference. It is also possible for the shielding element to protrude from the first end area of the housing essentially around the entire circumference.

According to one embodiment of the invention, the shielding element may have a rotationally symmetrical design. This may in particular involve nonessential features of the shielding element, which do not or do not significantly affect the function, not being rotationally symmetrical.

According to one embodiment of the invention, the lamp may have a control unit 601. The control unit 601 may be designed to control the illuminant.

According to one embodiment of the invention, the control unit 601 may be designed to adjust the brightness of the illuminant.

According to one embodiment of the invention, the lamp may have a contact sensor 602 that is designed to detect contact by a human finger. This may take place inductively or capacitively, for example. The contact sensor 602 may be designed to output a signal to the control unit when contact is detected. The control unit 601 may be designed to control the illuminant based on this signal.

According to one embodiment of the invention, the contact sensor may be situated on the shielding element.

According to one embodiment of the invention, the contact sensor may be situated adjacent to the recess.

According to one embodiment of the invention, the contact sensor may be situated circumferentially around the recess.

According to one embodiment of the invention, the illuminant may be designed to illuminate in different colors.

According to one embodiment of the invention, the lamp may include an energy store 603. The energy store 603 may be chargeable. The energy store 603 may be designed as a rechargeable battery, for example.

According to one embodiment of the invention, the energy store 603 may be chargeable via the contact sensor 602. The contact sensor may thus be used as an electrical contact for charging the energy store. For this purpose, the lamp may include a charging means having electrical contacts, with the housing being placeable on the charging means in such a way that the electrical contacts of the charging means are in contact with the contact sensor.

According to one embodiment of the invention, the energy store may be inductively chargeable.

According to one embodiment of the invention, the illuminant may be designed to display a state of charge of the energy store in color. For example, the illuminant may be designed to light up red during the charging operation. A completed charging operation may be displayed by the illuminant lighting up green.

BRIEF DESCRIPTION OF THE DRAWINGS

Further features and advantages of the present invention will become clear based on the following description of preferred exemplary embodiments, with reference to the appended figures. The same reference numerals are used for identical or similar components, and for components having identical or similar functions. In the figures.

DETAILED DESCRIPTION

Figure 2:
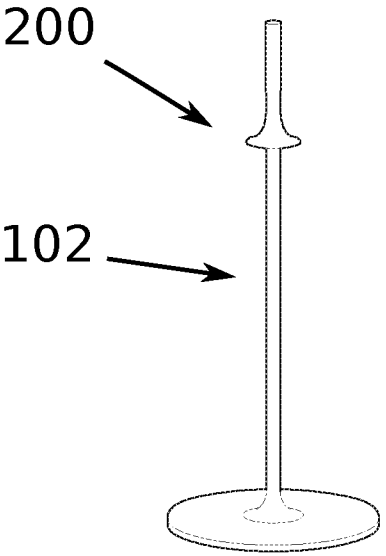
FIG. 2 shows a schematic view of the stand from FIG. 1.

The lamp comprises a housing 100, a shielding element 101, and a stand 102. A recess extends centrally through the housing 100. The shielding element 101 covers a first end area of the housing 100 and protrudes from the first end area. The stand 102 is inserted into the recess, so that the housing 100 is held by the stand 102. For this purpose, the stand 102 has a stop element 200 having a shape that is complementary to a second end area of the housing 100, so that the second end area and the stop element 200 lie flatly against one another. The second end area is situated opposite from the first end area.

The shielding element 101 has a first standing area 103 that is designed to rest on a flat surface. The first standing area 103 is directed away from the housing 100. The lamp with the first standing area 103 may thus be set on a flat surface in a particularly satisfactory manner.

Figure 1:
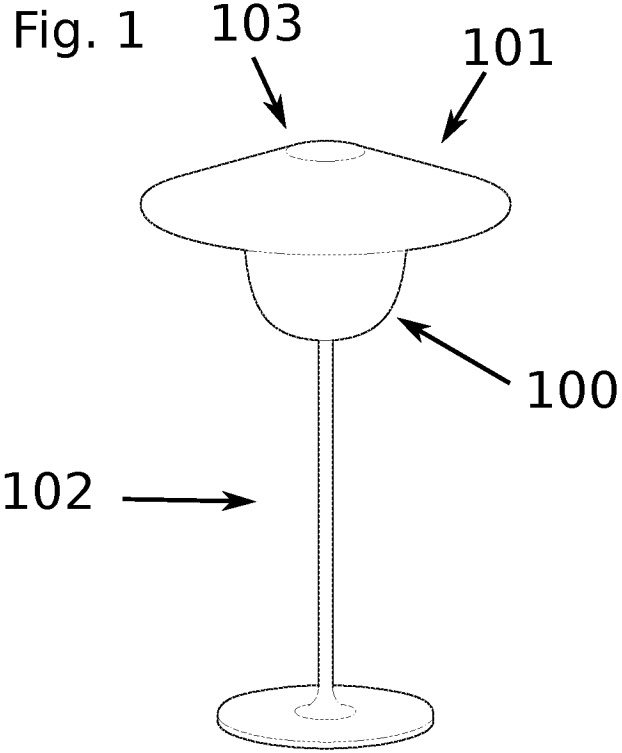
FIG. 1 shows a schematic view of a lamp according to one embodiment of the invention, with a stand.
Figure 3:
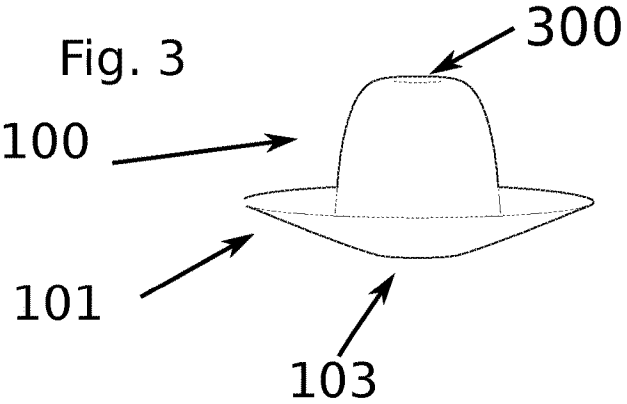
FIG. 3 shows a schematic view of the lamp from FIG. 1, which is situated on a first standing area of the shielding element.

Thus, two applications of the lamp arise from FIGS. 1 through 3. On the one hand, the lamp may be used with the stand 102 as a standing lamp. On the other hand, the lamp may be turned upside down and placed with the first standing area 103 on a flat surface. A further possible application arises from FIGS. 4 and 5.

A suspension means 400 via which the lamp may be hung may be introduced into the recess. The suspension means 400 is introduced into the recess from a first side, whereas the stand is introduced into the recess from a second side. The first side is situated opposite from the second side. The suspension means 400 is elastically deformable, and in the elastically deformable state may be introduced into the recess.

The suspension means 400 has two detent elements 500 that engage with detent sections of the housing 100 when the suspension means 400 is inserted into the recess. The detent elements are pressed into the detent sections by the elastic restoring force of the suspension means. The lamp is thus securely mounted on the suspension means 400.

For example, a cable 401 via which the lamp is fastenable to a fastening means may be affixed to the suspension means.

Figure 4:
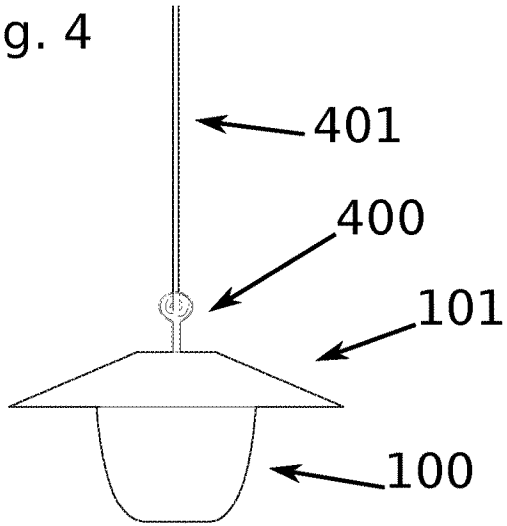
FIG. 4 shows a schematic view of the lamp from FIG. 1 with a suspension means.
Figure 5:
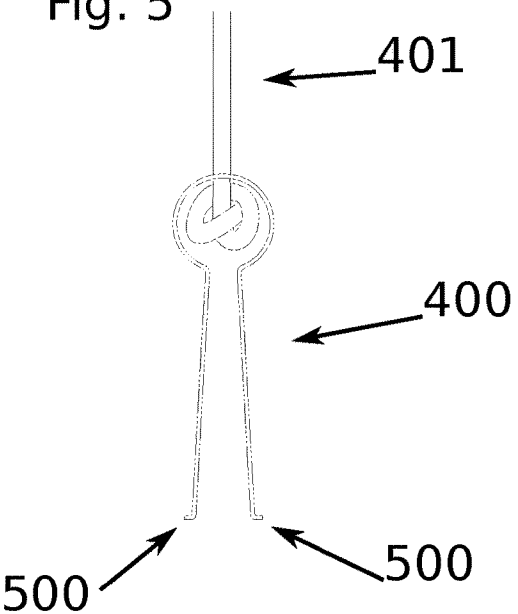
FIG. 5 shows a schematic view of the suspension means from FIG. 4.
Figure 6:
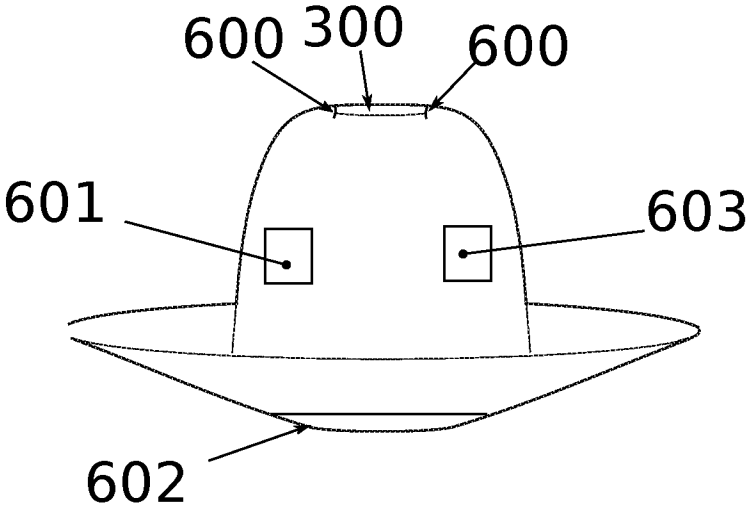
FIG. 6 is a schematic view of a lamp according to another embodiment.
Figure 7:
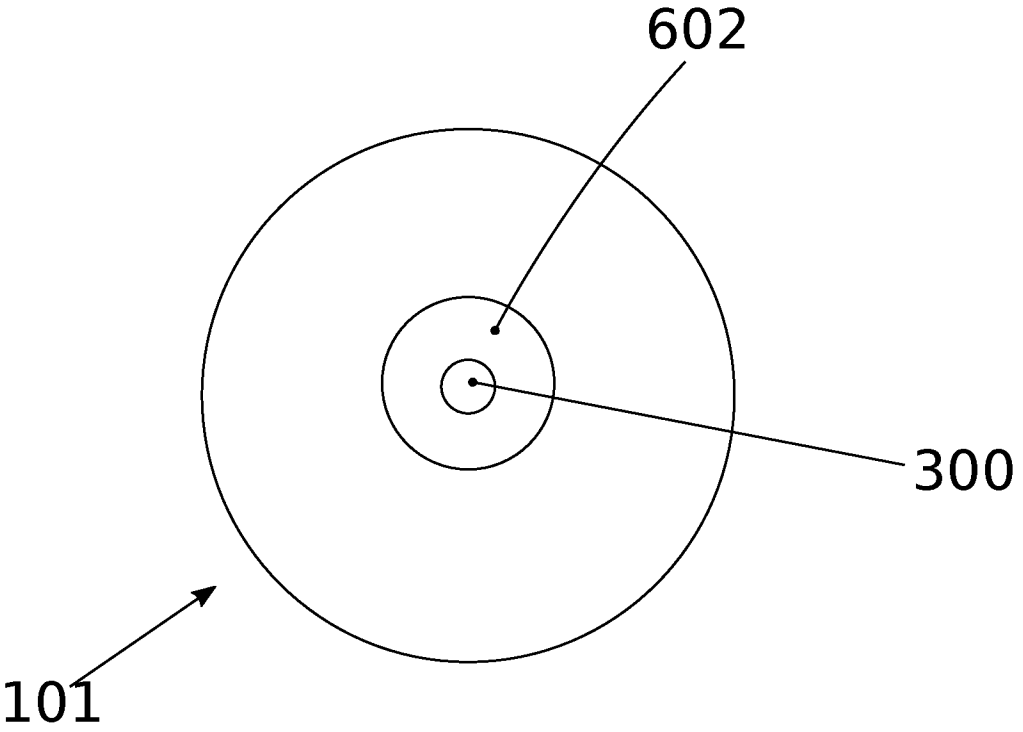
FIG. 7 is a bottom end view of the lamp shown in FIG. 6.

The lamp is thus usable in a particularly flexible manner. It may be used as a standing lamp (FIG. 1) or as a hanging lamp (FIG. 4). In addition, with the first standing area 103 of the shielding element 101 it may be placed on a flat surface in such a way that the shielding element 101 is situated below the housing 100 (FIG. 3).

This application claims the benefit of patent application DE 202019101459.8, filed Mar. 14, 2019, the entire disclosure of which is hereby incorporated by reference.

The invention claimed is:

1. A lamp comprising:

a housing having a first end area;

an illuminant provided in the housing, the lamp having a recess that extends through the housing; and a shielding element provided on the housing to at least partially cover and protrude from the first end area of the housing, and having a first standing area opposite the housing.

2. The lamp according to claim 1, wherein the first standing area includes a flat portion configured to support the lamp on a horizontal plane.

3. The lamp according to claim 1, wherein the first standing area has a ring-shaped design.

4. The lamp according to claim 1, wherein the recess extends centrally through the housing.

5. The lamp according to claim 1, wherein the shielding element protrudes circumferentially from the first end area of the housing.

6. The lamp according to claim 1, wherein the shielding element has a rotationally symmetrical design.

7. The lamp according claim 1, wherein the illuminant is a multi-colored light source configured to illuminate in different colors.

8. The lamp according to claim 1, wherein the housing has a second standing area with a flat portion configured to support the lamp on a horizontal plane.

9. The lamp according to claim 8, wherein the second standing area is situated in a second end area of the housing, wherein the second end area is situated opposite from the first end area.

10. The lamp according to claim 1, wherein the lamp has a control unit configured to control the illuminant.

11. The lamp according to claim 10, wherein the control unit is configured to adjust the brightness of the illuminant.

12. The lamp according to claim 1, wherein the lamp includes a stand configured to receive the housing.

13. The lamp according to claim 12, wherein the stand is configured to be received in the recess.

14. The lamp according to claim 12, wherein the stand includes a stop element, wherein the stop element is shaped to be coupled to the second end area of the housing.

15. The lamp according claim 1, wherein the lamp includes a rechargeable energy store.

16. The lamp according to claim 15, wherein the energy store is chargeable via the contact sensor.

17. The lamp according to claim 15, wherein the energy store is inductively chargeable.

18. The lamp according to claim 15, wherein the illuminant is a multi-colored light source configured to illuminate in different colors to indicate a state of charge of the energy store.

19. The lamp according to claim 1, wherein the lamp includes a suspension means that is introducible into the recess.

20. The lamp according to claim 19, wherein the suspension means is configured to be inserted into the recess proximate the first end area, and the stand is configured to be inserted into the recess proximate a second end area opposite the first end area.

21. The lamp according to claim 19, wherein the suspension means is elastically deformable and configured to be inserted into the recess to support the housing.

22. The lamp according to claim 21, wherein the housing has detent sections formed about the recess, wherein the suspension means has detent elements configured to engage with the detent sections to support the housing.

23. The lamp according to claim 1, wherein the lamp has a control unit configured to control the illuminant, and a contact sensor configured to detect contact by a human finger and output a signal to the control unit, wherein the control unit is further configured to control the illuminant based on the signal.

24. The lamp according to claim 23, wherein the contact sensor is provided on the shielding element.

25. The lamp according to claim 23, wherein the contact sensor is provided adjacent to the recess.

26. The lamp according to claim 25, wherein the contact sensor is provided circumferentially around the recess.

* * * * *